US009296582B2

(12) United States Patent
Okumura

(10) Patent No.: US 9,296,582 B2
(45) **Date of Patent: *Mar. 29, 2016**

(54) TRANSPORT APPARATUS AND RECORDING APPARATUS PROVIDED WITH THE SAME

(71) Applicant: BROTHER KOGYO KABUSHIKI KAISHA, Nagoya-shi, Aichi-ken (JP)

(72) Inventor: Masayuki Okumura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/568,770

(22) Filed: Dec. 12, 2014

(65) Prior Publication Data

US 2015/0225194 A1 Aug. 13, 2015

Related U.S. Application Data

(63) Continuation of application No. 14/038,467, filed on Sep. 26, 2013, now Pat. No. 8,919,772.

(30) Foreign Application Priority Data

Sep. 28, 2012 (JP) ..... 2012-218362

(51) Int. Cl.
*B65H 9/10* (2006.01)
*B65H 5/06* (2006.01)
*B65H 85/00* (2006.01)
(Continued)

(52) U.S. Cl.
CPC ..... *B65H 9/106* (2013.01); *B65H 5/062* (2013.01); *B65H 5/068* (2013.01); *B65H 5/26* (2013.01); *B65H 7/20* (2013.01); *B65H 9/166* (2013.01); *B65H 29/60* (2013.01); *B65H 85/00* (2013.01); *B65H 2402/31* (2013.01);
(Continued)

(58) Field of Classification Search
CPC ..... B65H 9/103; B65H 9/106; B65H 9/166; B65H 2301/331; B65H 2402/31; B65H 2404/14212; B65H 2404/15212
See application file for complete search history.

(56) References Cited

U.S. PATENT DOCUMENTS 5,697,609 A * 12/1997 Williams et al. ..... 271/228
6,619,658 B2 * 9/2003 Shiau ..... 271/274
(Continued)

FOREIGN PATENT DOCUMENTS

JP S61-2642 A 1/1986
JP S63-127955 A 5/1988
(Continued)

OTHER PUBLICATIONS

Translation of JP 06278914 A, retrieved Jun. 25, 2014.*
(Continued)

*Primary Examiner* — Michael McCullough
(74) *Attorney, Agent, or Firm* — Merchant & Gould P.C.

(57) ABSTRACT

A transport apparatus includes: a guide surface which extends in a transport direction for transporting a medium and which is configured to guide the medium to be transported; a first roller which is a driving roller for transporting the medium; a second roller which is a driven roller arranged to face the first roller; and a roller support member which rotatably supports the second roller and which is configured to be pivotable about a support shaft perpendicular to an axis of a rotational shaft of the second roller between a first position and a second position.

13 Claims, 8 Drawing Sheets

(51) Int. Cl.

| | |
|---|---|
| ***B65H 9/16*** | (2006.01) |
| ***B65H 5/26*** | (2006.01) |
| ***B65H 7/20*** | (2006.01) |
| ***B65H 29/60*** | (2006.01) |

(52) U.S. Cl.

CPC .. *B65H 2402/5152* (2013.01); *B65H 2402/543* (2013.01); *B65H 2402/545* (2013.01); *B65H 2404/1115* (2013.01); *B65H 2404/144* (2013.01); *B65H 2404/15212* (2013.01); *B65H 2404/611* (2013.01)

(56) References Cited

U.S. PATENT DOCUMENTS

| | | | | |
|---|---|---|---|---|
| 8,919,772 | B2 * | 12/2014 | Okumura | 271/251 |
| 2004/0135310 | A1 | 7/2004 | Yang | |

FOREIGN PATENT DOCUMENTS

| | | | | | |
|---|---|---|---|---|---|
| JP | 06278914 | A | * | 10/1994 | B65H 9/16 |
| JP | H06-278914 | A | | 10/1994 | |
| JP | H08-259049 | A | | 10/1996 | |
| JP | 2007-161361 | A | | 6/2007 | |

OTHER PUBLICATIONS

Notification of First Office Action issued in corresponding Chinese Application No. 201310446191.X; Jun. 30, 2015 with English translation (22 pages).

Notice of Reasons for Rejection mailed in related Japanese application No. 2012-218362, Jan. 26, 2016.

* cited by examiner

TRANSPORT APPARATUS AND RECORDING APPARATUS PROVIDED WITH THE SAME

CROSS REFERENCE TO RELATED APPLICATION

The present application is a continuation of U.S. patent application Ser. No. 14/038,467, filed Sep. 26, 2013, and further claims priority from Japanese Patent Application No. 2012-218362, filed on Sep. 28, 2012, the disclosures of both of which are incorporated herein by reference in their entirety.

BACKGROUND OF THE INVENTION

1. Field of the Invention

The present invention relates to a transport apparatus for transporting a medium and a recording apparatus provided with the same.

2. Description of the Related Art

There is known a side registration apparatus including a side guide plate (guide unit) which is parallel to the transport direction, a driving roller (first roller) which transports the recording paper, and an idler roller (second roller) which is opposed to the driving roller with the transport path (passage) of the recording paper intervening therebetween. In this apparatus, a holding member, which supports the idler roller, positions the idler roller at a first position at which a shaft portion (rotational shaft) of the idler roller is inclined with respect to the guide surface of the side guide plate and a second position at which the shaft portion is substantially perpendicular to the guide surface. The holding member is swingable about the center of a coupling rod (connecting bar) separated from the position disposed on the axis of the shaft portion of the idler roller. Further, the holding member is urged by a torsion spring in the direction in which the idler roller is directed from the second position to the first position. When the recording paper arrives at the driving roller and the idler roller, the recording paper is fed obliquely toward the side guide plate by means of the driving roller and the idler roller.

After one forward end corner portion of the recording paper abuts against the guide surface of the side guide plate, the recording paper is rotated so that the recording paper travels along the concerning guide surface. In this situation, the holding member is pivoted so that the idler roller is moved from the first position to the second position against the urging force of the torsion spring in accordance with the rotation of the recording paper. Accordingly, the force to extrude the recording paper to the side guide plate is mitigated, and it is intended to suppress any damage of the recording paper.

SUMMARY OF THE INVENTION

In the abovementioned apparatus, the idler roller is returned from the second position to the first position after the passage of the backward end of the recording paper. During this process, the idler roller is returned to the first position while making contact with the driving roller. In this situation, in the abovementioned apparatus, the direction of movement of the idler roller 12 is approximately the same direction as the extending direction of the shaft portion of the idler roller. Therefore, the friction is extremely large between the both rollers, and it is feared that the idler roller is not returned to the first position.

According to an aspect of the present invention, there is provided a transport apparatus including: a guide surface which extends in a transport direction for transporting a medium and which is configured to guide the medium to be transported; a first roller which is a driving roller for transporting the medium; a second roller which is a driven roller arranged to face the first roller; and a roller support member which rotatably supports the second roller and which is configured to be pivotable about a support shaft perpendicular to an axis of a rotational shaft of the second roller between a first position and a second position, wherein in a state that the roller support member is positioned at the first position, an angle formed by a portion of the guide surface, which is disposed on a downstream side in the transport direction from a point of intersection between the axis of the rotational shaft of the second roller and the guide surface, and the axis of the rotational shaft of the second roller is an acute angle, and wherein in a state that the roller support member is positioned at the second position, the angle approaches a right angle as compared with the state that the roller support member is positioned at the first position.

Accordingly, when the medium is transported by the first roller and the second roller, the second roller is moved from the first position to the second position after the medium abuts against the guide surface. After that, the second roller is returned from the second position to the first position after the medium passes through between the first roller and the second roller. In this arrangement, the support shaft of the roller support member for supporting the second roller is arranged on the axis of the rotational shaft of the second roller. Therefore, the direction, in which the second roller moves along with the pivot of the roller support member, is approximately the same direction as the rotating direction of the second roller. Accordingly, the second roller is moved from the second position toward the first position while being rotated. Therefore, the friction is decreased between the second roller and the first roller when the second roller is moved, and thus the second roller is moved with ease.

BRIEF DESCRIPTION OF THE DRAWINGS

FIGS. 4A and 4B show rotation situations of the roller support member, wherein FIG. 4A shows a situation in which the roller support member is positioned at the first position, and FIG. 4B shows a situation in which the roller support member is positioned at the second position.

FIGS. 5A and 5B show situations of the spur roller which is movable in accordance with the rotation of the roller support member, wherein FIG. 5A shows a situation in which the spur roller is positioned at the first position, and FIG. 5B shows a situation in which the spur roller is positioned at the second position.

FIGS. 7A and 7B show a modified embodiment of the oblique feeding roller pair of the transport apparatus of the present invention, wherein FIG. 7A shows an arrangement relationship with respect to a driving roller when a spur roller is positioned at the first position, and FIG. 7B shows an arrangement relationship with respect to the driving roller when the spur roller is positioned at the second position.

DESCRIPTION OF THE EMBODIMENTS

An embodiment of the present invention will be explained below with reference to the drawings.

At first, an explanation will be made about the overall arrangement of an ink jet printer 1 as one embodiment of the recording apparatus having the transport apparatus according to the present invention.

Figure 1:
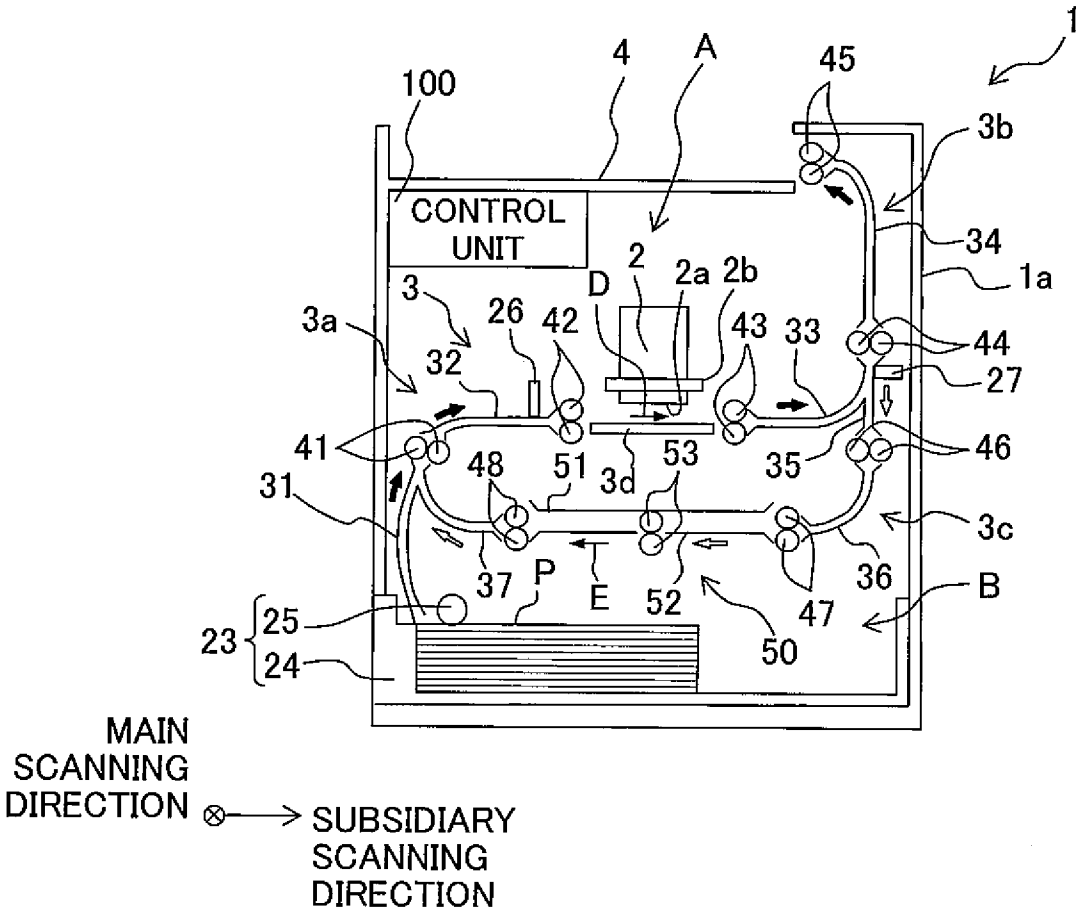
FIG. 1 shows a schematic side view illustrating the internal structure of an ink jet printer which is an embodiment of the recording apparatus provided with the transport apparatus according to the present invention.

The printer 1 has a casing la having a rectangular parallelepiped shape. A paper discharge unit 4 is provided at an upper portion of a ceiling plate of the casing la. The internal space of the casing la can be classified into Spaces A, B in this order from the top. Those formed in Spaces A, B are a recording paper transport path which is directed from a paper feed unit 23 to the paper discharge unit 4, and a recording paper refeed path which is directed from the downstream side to the upstream side of the recording paper transport path. As shown in FIG. 1, the recording paper P is transported along black thick arrows in the recording paper transport path, and the recording paper P is transported along blanked thick arrows in the recording paper refeed path. In Space A, the image recording on the recording paper P, the transport of the recording paper P to the paper discharge unit 4, and the refeeding of the recording paper P are performed. In Space B, the paper feeding from the paper feed unit 23 to the recording paper transport path is performed.

For example, a head (recording head) 2 for discharging the black ink, a transport apparatus 3, and a control unit 100 are arranged in Space A. Further, an unillustrated cartridge is installed in Space A. The black ink is stored in the cartridge. The cartridge is connected to the head 2 via a tube and a pump (both are not shown), and the ink is supplied to the head 2.

The head 2 is a line type head having a lengthy substantially rectangular parallelepiped shape in the main scanning direction. The lower surface of the head 2 is a discharge surface 2*a* on which a large number of discharge ports are open. When the recording is performed, the black ink is discharged from the discharge surface 2*a*. The head 2 is supported by the casing la by the aid of a head holder 2*b*. The head holder 2*b* holds the head 2 so that a predetermined gap, which is suitable for the recording, is formed between the discharge surface 2*a* and a platen 3*d* (described later on).

The transport apparatus 3 has an upstream guide unit 3*a*, a downstream guide unit 3*b*, a refeed guide unit 3*c*, and the platen 3*d*. The platen 3*d* is arranged at a position opposed to the discharge surface 2*a* of the head 2. The platen 3*d* has a flat upper surface. The platen 3*d* supports the recording paper P from the lower position, and the platen 3*d* constitutes the recording area (part of the recording paper transport path) between the discharge surface 2*a* and the platen 3*d*. The upstream guide unit 3*a* and the downstream guide unit 3*b* are arranged with the platen 3*d* intervening therebetween. The upstream guide unit 3*a* has two guides 31, 32 and two transport roller pairs 41, 42, and the upstream guide unit 3*a* connects the recording area (space between the platen 3*d* and the head 2) and the paper feed unit 23. The downstream guide unit 3*b* has two guides 33, 34 and three transport roller pairs 43 to 45, and the downstream guide unit 3*b* connects the recording area and the paper discharge unit 4. The recording paper transport path is defined by the four guides 31 to 34, the platen 3*d*, and the head 2.

The refeed guide unit 3*c* has three guides 35 to 37, three transport roller pairs 46 to 48, and a positioning mechanism 50, and the refeed guide unit 3*c* connects the upstream guide unit 3*a* and the downstream guide unit 3*b* while making a detour to avoid the recording area. The guide 35 is connected to an intermediate portion of the guide 33, and the guide 35 connects the refeed guide unit 3*c* and the downstream guide unit 3*b*. The guide 37 is connected to an intermediate portion of the guide 31, and the guide 37 connects the refeed guide unit 3*c* and the upstream guide unit 3*a*. The recording paper refeed path is defined by the three guides 35 to 37 and the positioning mechanism 50.

As for the transport roller pair 44, the transport direction of the recording paper P is switched in accordance with the control of the control unit 100. In other words, the transport roller pair 44 is rotated so that the recording paper P is transported upwardly when the recording paper P is transported from the recording area to the paper discharge unit 4. On the other hand, when the recording paper P is transported from the recording paper transport path to the recording paper refeed path, the direction of rotation of the transport roller pair 44 is switched so that the recording paper P is transported downwardly while using the backward end of the recording paper P as the forward end when the backward end of the recording paper P is disposed between the transport roller pair 44 and the connecting portion between the guide 33 and the guide 35 and the backward end of the recording paper P is detected or sensed by a recording paper P sensor 27. The recording paper P, which is transported from the recording paper transport path to the recording paper refeed path, is refed to the upstream guide unit 3*a*. In this situation, the recording paper P, which is subjected to the refeeding, is transported again to the recording area in a state in which the recording paper P is inverted upside down as compared with when the recording paper P passed through the recording area just before. Thus, it is possible to record images on the both surfaces of the recording paper P.

The three transport roller pairs 46 to 48 are arranged in this order, and the positioning mechanism 50 is arranged between the transport roller pairs 47, 48. Further, the positioning mechanism 50 is arranged between the recording area (platen 3*d*) and the paper feed unit 23 in relation to the vertical direction. The positioning mechanism 50 has an upper guide 51, a lower guide 52, and an oblique feeding roller pair 53. The positioning mechanism 50 transports the recording paper P while allowing one end in the widthwise direction (main scanning direction, i.e., perpendicular direction perpendicular to the transport direction E of the recording paper P) of the recording paper P transported to the space between the both guides 51, 52 to abut against a guide surface 54*a* (described later on), and thus the positioning mechanism 50 positions the recording paper P in the widthwise direction. Details of the positioning mechanism 50 will be described later on.

The paper feed unit 23 is arranged in Space B. The paper feed unit 23 has a paper feed tray 24 and a paper feed roller 25. In particular, the paper feed tray 24 is installable/removable (detachable) with respect to the casing 1*a*. The paper feed tray 24 is a box which is open upwardly, and the paper feed tray 24 can accommodate a plurality of sheets of the recording paper P. The paper feed roller 25 feeds a sheet of the recording paper P which is disposed at the uppermost position in the paper feed tray 24.

In this arrangement, the subsidiary scanning direction is the direction parallel to the recording paper transport direction D in which the recording paper P is transported by the transport roller pairs 42, 43 and the recording paper transport direction E in which the recording paper P is transported by the transport roller pairs 47, 48 and the oblique feeding roller pair 53. The main scanning direction is the direction parallel to the horizontal plane and perpendicular to the subsidiary scanning direction.

Next, the control unit 100 will be explained. The control unit 100 controls the operation of respective components of the printer 1, and the control unit 100 manages the operation of the entire printer 1. The control unit 100 controls the recording operation on the basis of the recording command or instruction supplied from any external apparatus (for example, PC connected to the printer 1). Specifically, the control unit 100 controls, for example, the transport operation for the recording paper P and the ink discharge operation in synchronization with the transport of the recording paper P.

For example, when a recording command to perform the recording on one side of the recording paper P is received from the external apparatus, the control unit 100 drives the paper feed unit 23 and the transport roller pairs 41 to 45 on the basis of the concerning recording command. The recording paper P, which is fed from the paper feed tray 24, is guided by the upstream guide unit 3*a*, and the recording paper P is fed to the recording area (space between the platen 3*d* and the head 2). When the recording paper P passes just under the head 2, then the head 2 is controlled by the control unit 100, and the ink droplets are discharged from the head 2. Accordingly, a desired image is recorded on the surface of the recording paper P. The ink discharge operation (ink discharge timing) is based on the detection signal supplied from a recording paper sensor 26. The recording paper sensor 26 is arranged upstream in the transport direction from the head 2, and the recording paper sensor 26 detects the forward end of the recording paper P. The recording paper P, on which the image has been recorded, is guided by the downstream guide unit 3*b*, and the recording paper P is discharged from the upper portion of the casing 1*a* to the paper discharge unit 4.

Further, for example, when a recording command to perform the recording on both sides of the recording paper P is received from the external apparatus, the control unit 100 drives the paper feed unit 23 and the transport roller pairs 41 to 45 on the basis of the concerning recording command. At first, an image is formed on the surface of the recording paper P in the same manner as in the one side recording, and the recording paper P is transported toward the paper discharge unit 4. As shown in FIG. 1, a recording paper sensor 27 is arranged in the vicinity of the upstream side of the transport roller pair 44, for the guide unit 3*b* at a position in the middle of the transport. When the recording paper sensor 27 detects the backward end of the recording paper P, then the transport roller pair 44 is reversely rotated, and the direction of the transport of the recording paper P is inverted under the control of the control unit 100. In this situation, the transport roller pairs 46 to 48 and the oblique feeding roller pair 53 are also driven. Accordingly, the transport path of the recording paper P is switched, and the recording paper P is transported along the recording paper refeed path (path indicated by the blanked arrows). Further, in this situation, the control unit 100 drives the transport roller pair 47 so that the transport speed of the recording paper P transported by the transport roller pair 47 is slightly faster than the transport speed of the recording paper P transported by the oblique feeding roller pair 53. Accordingly, when the recording paper P is obliquely fed by the oblique feeding roller pair 53, any back tension, which would be otherwise caused by the transport roller pair 47, is not generated with respect to the recording paper P. Therefore, the recording paper P can be effectively fed obliquely. As a result, the recording paper P, which has been positioned in relation to the main scanning direction, can be refed to the recording area. The recording paper P, which is refed from the recording paper refeed path to the upstream guide unit 3*a*, is supplied again while being disposed upside down in the recording area, and an image is recorded on the back surface. When the forward end of the recording paper P is detected by the recording paper sensor 26 prior to the image recording on the back surface, the transport roller pair 44 is returned to perform the forward rotation. The recording paper P, which has been subjected to the both sides recording, is discharged to the paper discharge unit 4 via the downstream guide unit 3*b*.

Figure 2:
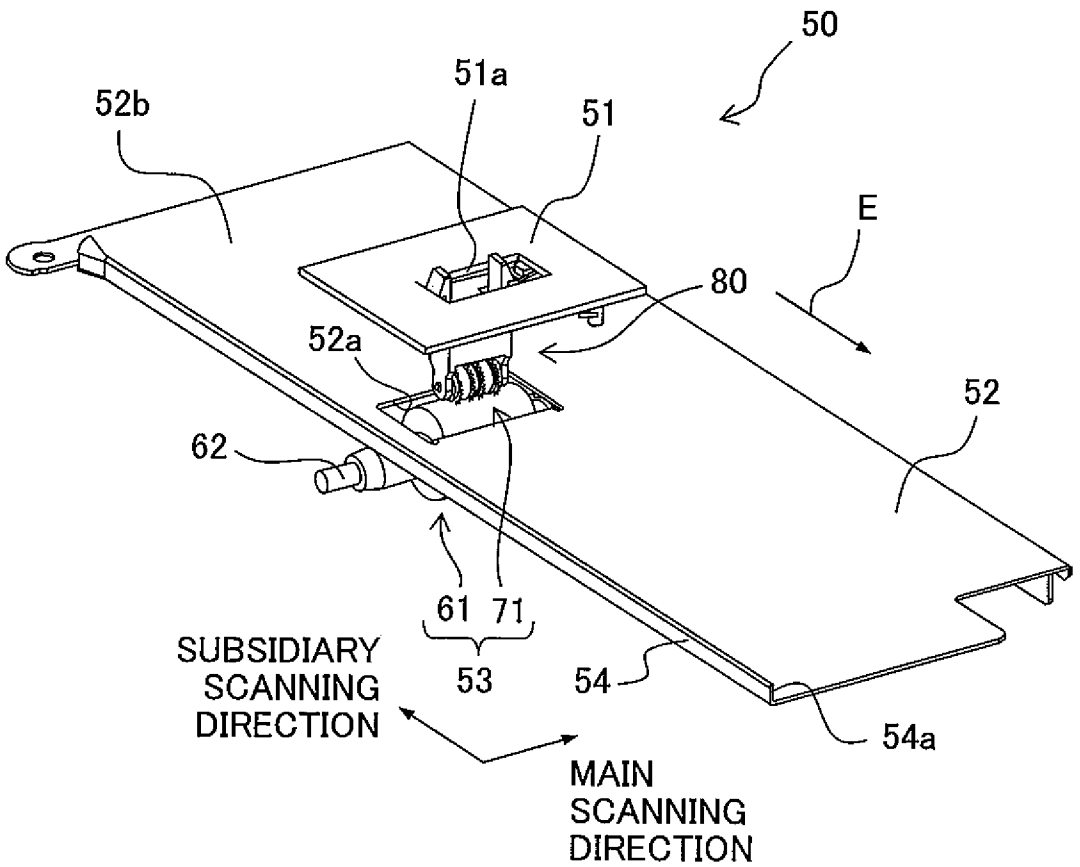
FIG. 2 shows a schematic perspective view illustrating a positioning mechanism shown in FIG. 1.

Next, the positioning mechanism 50 will be explained in detail with reference to FIGS. 2 to 6. As shown in FIG. 2, both of the upper guide 51 and the lower guide 52 of the positioning mechanism 50 are plate-shaped members which are arranged while being separated from each other in the vertical direction. The space, which is provided between the guides 51, 52, constitutes a part of the recording paper refeed path. The upper guide 51 is formed with a hole 51*a* which penetrates in the thickness direction. The lower guide 52 has a hole 52*a* which is formed at a position opposed to the hole 51*a*. The flat surface size of the hole 52*a* is larger than that of the hole 51*a*, and the flat surface size in the subsidiary scanning direction is slightly smaller than that of a driving roller 61 described later on (see FIGS. 5A and 5B). The lower guide 52 has a transport surface 52*b* which supports the lower surface of the transported recording paper P. A vertical portion 54, which is provided upstandingly in the vertical direction, is formed at one end of the lower guide 52 in the main scanning direction. The vertical portion 54 extends in the subsidiary scanning direction. A guide surface 54*a*, which is the vertical surface including the subsidiary scanning direction in the in-plane direction, is formed for the vertical portion 54. The guide surface 54*a* is formed on the side surface disposed on the other end side of the both side surfaces of the vertical portion 54 in the main scanning direction. In FIG. 2, only a part of the upper guide 51 is shown.

The oblique feeding roller pair 53 is constructed by a driving roller (first roller) 61 and a spur roller (second roller) 71 which is opposed to the driving roller 61. The spur roller 71 is the driven roller which is rotated in accordance with the rotation of the driving roller 61 or the transport of the recording paper P transported by the driving roller 61. As shown in FIG. 2, the driving roller 61 is arranged at the position opposed to the hole 52*a*, and the driving roller 61 is arranged at the lower position as compared with the spur roller 71. The driving roller 61 is arranged so that the upper end thereof slightly protrudes upwardly from the transport surface 52*b* of the lower guide 52 to make contact with the lower surface of the recording paper P transported onto the transport surface 52*b*. The driving roller 61 is rotatably supported by a shaft portion (rotational shaft) 62 with respect to the casing 1*a*. The driving roller 61 is arranged so that the axis M of the shaft portion 62 is parallel to the main scanning direction (see FIGS. 5A and 5B). The positioning mechanism 50 has an unillustrated driving motor. The driving motor is driven under the control of the control unit 100 to rotate the driving roller 61 by the aid of the shaft portion 62.

Figure 3B:
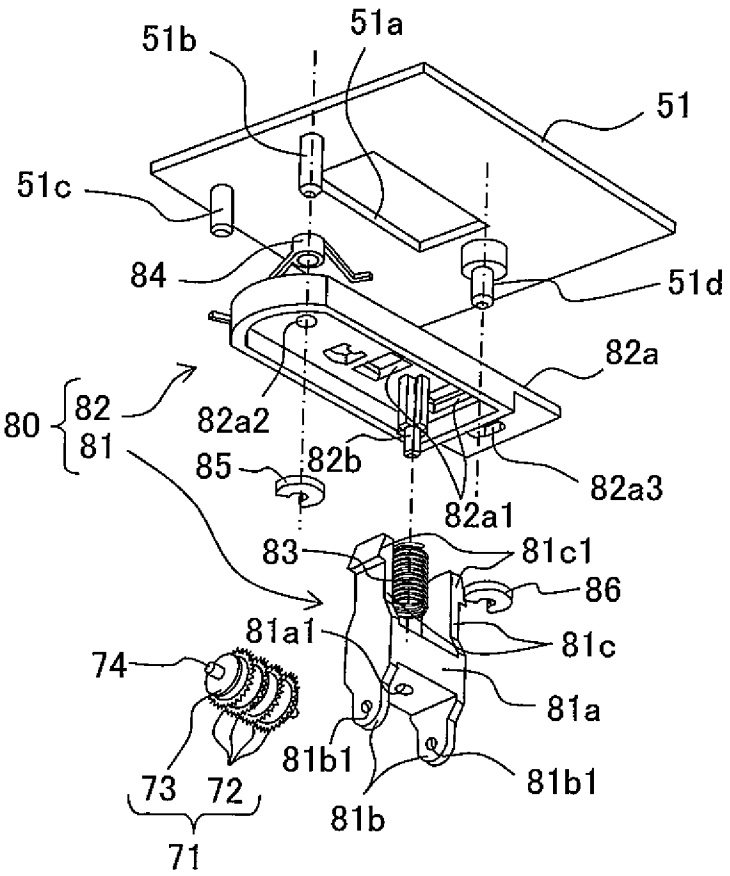
FIGS. 3A and 3B show exploded perspective views each illustrating a spur roller, a roller support member, and an upper guide shown in FIG. 2.
Figure 3A:
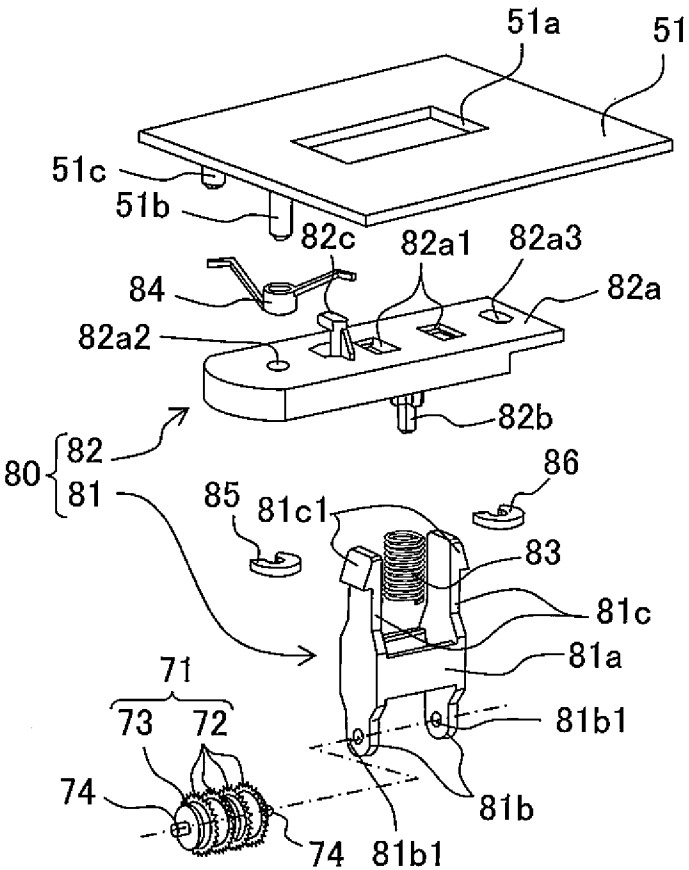
Figure 6:
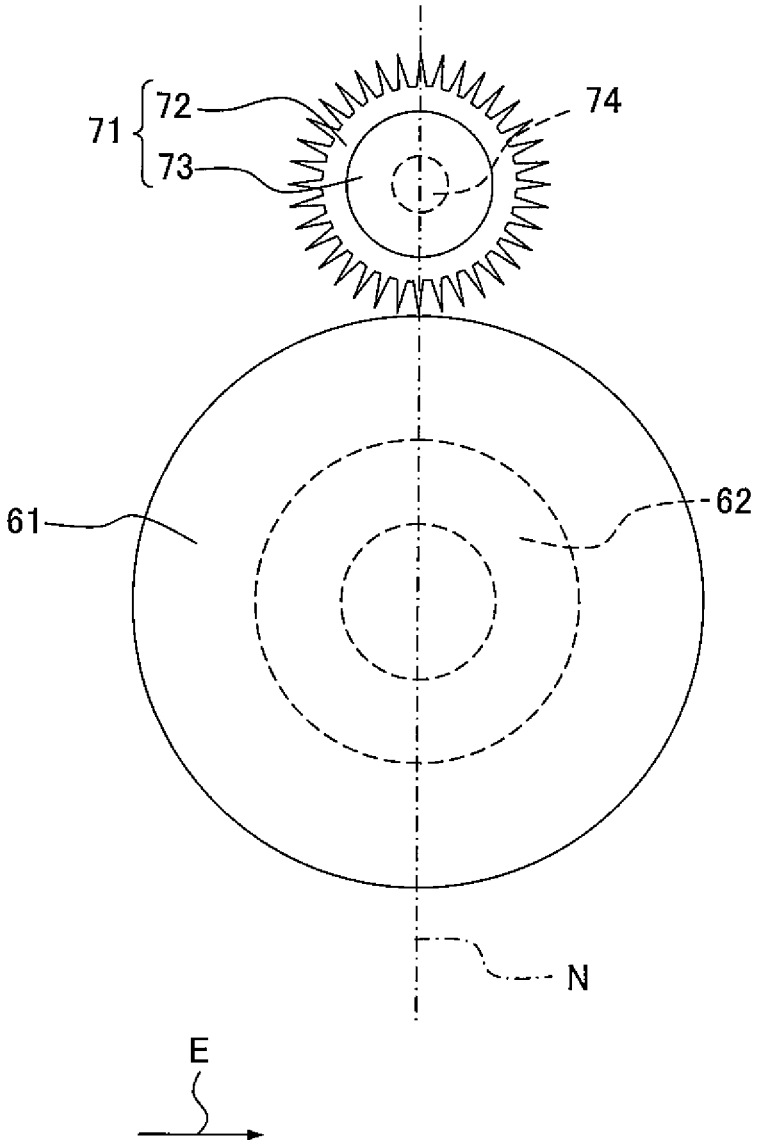
FIG. 6 shows a sectional view illustrating an oblique feeding roller pair provided when the spur roller is positioned at the second position.

As shown in FIGS. 3A and 3B, the positioning mechanism 50 has a roller support member 80 for supporting the spur roller 71, a compression coil spring (second urging member) 83, and a torsion coil spring (first urging member) 84. As shown in FIGS. 3A, 3B and 6, the spur roller 71 has four annular spurs 72, and a columnar roller main body 73 having an outer circumferential side surface on which the spurs 72 are fixed. As shown in FIG. 3A, a shaft portion 74, which serves as the rotational shaft of the spur roller 71, is formed on each of both end surfaces of the roller main body 73.

As shown in FIGS. 3A and 3B, the roller support member 80 has a holding member 81 which rotatably holds or retains the spur roller 71, a rotatable member 82, and two fasters 85, 86. The holding member 81 has a main body 81*a*, a pair of lower flanges 81*b*, and a pair of upper flanges 81*c*. A hole 81*a*1, which penetrates in the vertical direction, is formed through a lower surface of a main body 81*a*. The pair of upper flanges 81*c* are formed to protrude upwardly from upper portions of the main body 81*a*. A hook 81*c*1 is formed at the upper end of each of the flanges 81*c*. The pair of lower flanges 81*b* are formed to protrude downwardly from lower portions of the main body 81*a*. A hole 81*b*1 is formed through each of the lower flanges 81*b*. The shaft portion 74 of the spur roller 71 is inserted into the holes 81*b* 1 , and thus the spur roller 71 is rotatably supported by the roller support member 80.

Figure 4A:
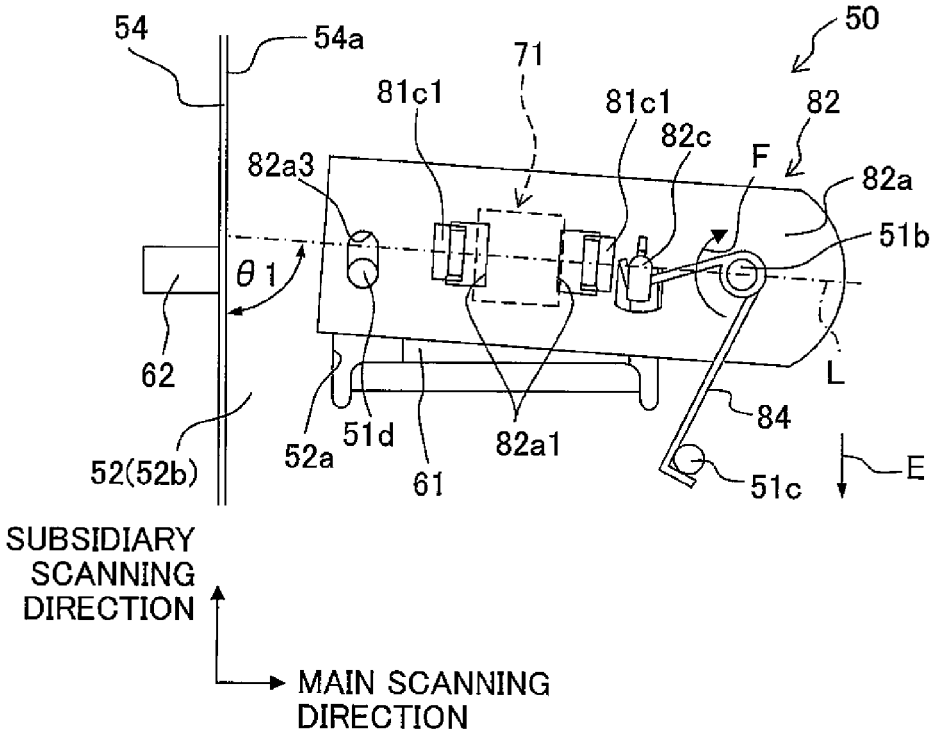
Figure 4B:
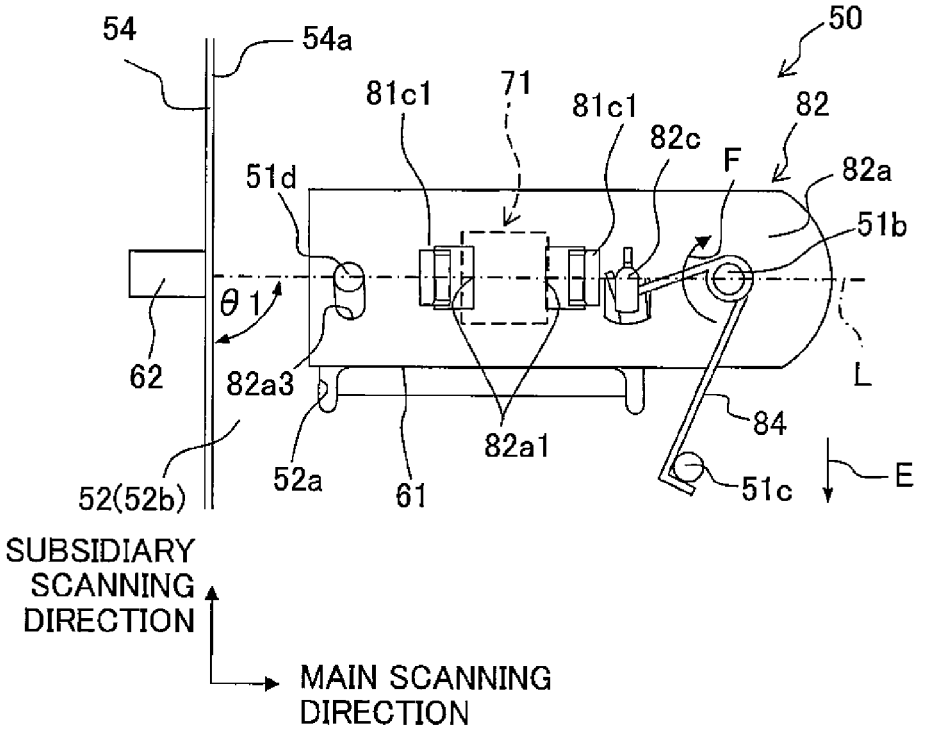

As shown in FIGS. 3A to 4B, the rotatable member 82 has a main body 82*a* which extends in the extending direction of the axis L of the shaft portion 74 of the spur roller 71, and protruding portions 82*a*, 82*c* which protrude from the upper surface and the lower surface of the main body 82*a* respectively. A pair of holes 82*a*1 and two holes 82*a*2, 82*a*3 are formed through the main body 82*a*. As shown in FIGS. 4A and 4B, the pair of holes 82*a*1 have sizes into which the hooks 81*c*1 of the pair of upper flanges 81*c* can be inserted. Further, the pair of holes 82*a*1 are constructed so that the inserted hooks 81*c*1 are engageable with outer portions of the holes 82*a*1. Accordingly, a state is given, in which the holding member 81 hangs from the rotatable member 82, and the holding member 81 is supported by the rotatable member 82 movably in the vertical direction. The holding member 81 is supported by the rotatable member 82 in a state in which the protruding portion 82*b* is inserted into the compression coil spring 83. In this situation, the compression coil spring 83 urges the holding member 81 downwardly with respect to the rotatable member 82. Accordingly, the spur roller 71 is urged in the direction in which the driving roller 61 is pressed. Therefore, the transport force can be effectively applied to the recording paper P transported to the space between the oblique feeding roller pair 53. When the holding member 81 is supported by the rotatable member 82, the forward end of the protruding portion 82*b* is inserted into the hole 81*a*1.

Three columnar protruding portions 51*b*, 51*c*, 51*d*, which protrude downwardly, are formed on the lower surface of the upper guide 51. The protruding portion (support shaft) 51*b* is formed to be long in the vertical direction as compared with the protruding portion 51*c*. The length in the vertical direction of the protruding portion 51*b* is approximately the same as that of the protruding portion 51*d*. The rotatable member 82 is supported in a state of being allowed to hang from the upper guide 51 by inserting the protruding portion 51*b* into the hole 82*a*2, inserting the protruding portion 51*d* into the hole 82*a*2, and fixing the fasters 85, 86 to the forward ends of the protruding portions 51*b*, 51*d*. In this situation, the rotatable member 82 is rotatably supported by the upper guide 51 about the center of rotation of the protruding portion 51*b*. As shown in FIGS. 4A and 4B, the protruding portion 51*b* is arranged to be perpendicular to the axis L of the shaft portion 74 of the spur roller 71. Specifically, the protruding portion 51*b* is arranged at a position far from the guide surface 54*a* as compared with the spur roller 71 in relation to the extending direction of the axis L. In other words, the entire spur roller 71 as well as the center of the spur roller 71 is positioned between the protruding portion 51*b* and the guide surface 54*a* in relation to the extending direction of the axis L. Further, the hole 82*a*3 has a slotted hole. The relative movement range is regulated for both of the protruding portion 51*d* and the hole 32*a*3. The roller support member 80 can be positioned at the first position and the second position. The first position is the position shown in FIGS. 4A and 5A, which is such a position that the angle θ1, which is formed by the axis L and the downstream portion of the guide surface 54*a* in the transport direction from the point of intersection between the axis L and the guide surface 54*a*, is, for example, 85 to 89° and more preferably 88° (acute angle). The second position is the position shown in FIGS. 4B and 5B, which is such a position that the concerning angle θ1 approaches the right angle as compared with when the first position is provided. In this embodiment, the roller support member 80 is regulated so that the roller support member 80 is rotatable until the angle θ1 arrives at the right angle by the protruding portion 51 d and the hole 82*a*3.

Figure 5A:
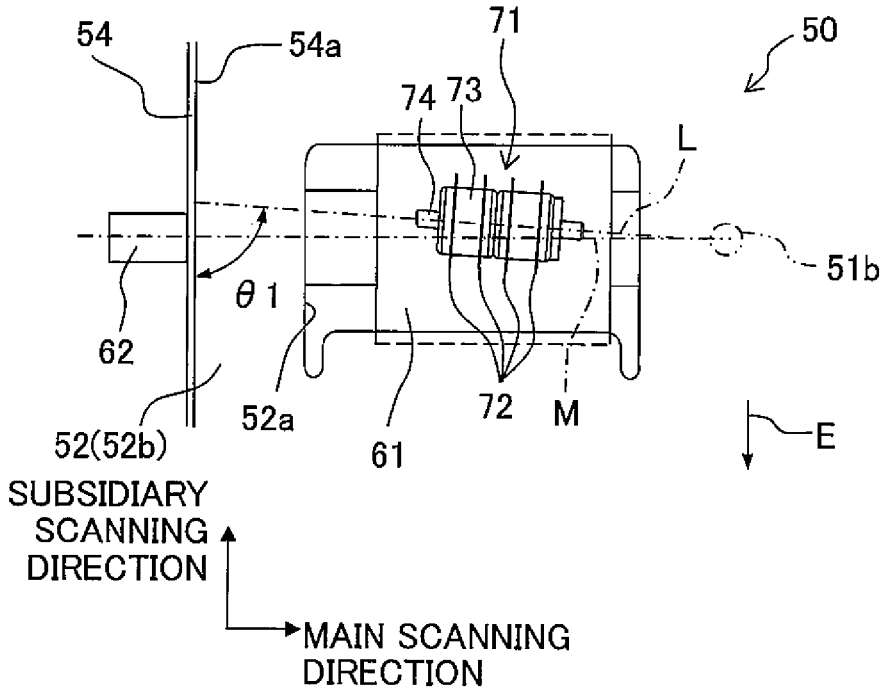
Figure 5B:
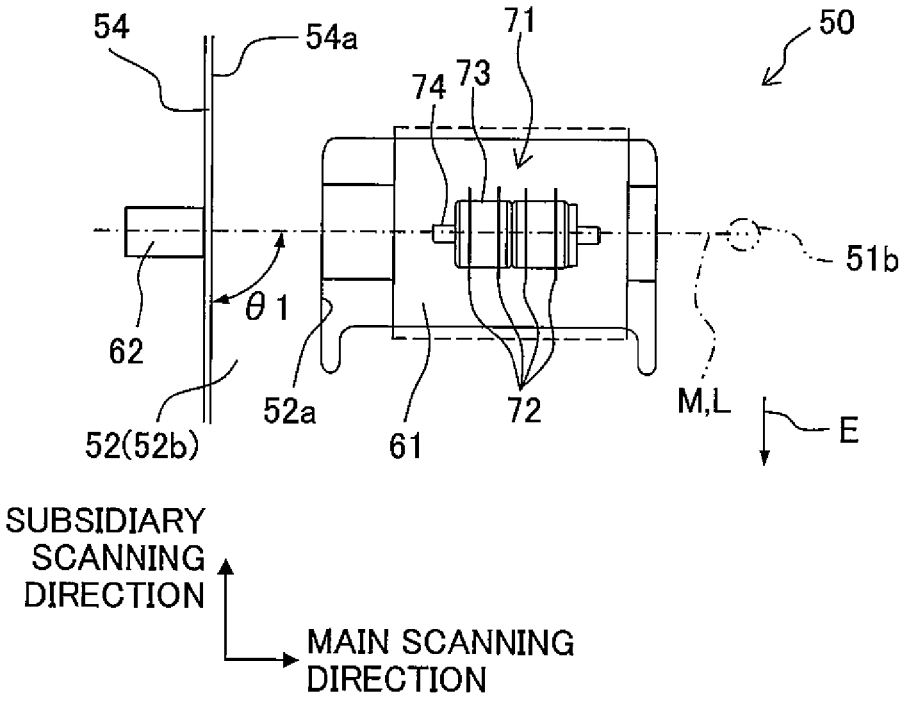

Further, as shown in FIGS. 5A and 5B, the pair of oblique feeding rollers 53 are arranged so that the lowermost portion of the spur roller 71 does not exceed the position disposed on the axis M of the shaft portion 62 of the driving roller 61 from the upstream side in the transport direction E even when the spur roller 71 is positioned at any one of the first position and the second position. Specifically, as shown in FIG. 5B, the lowermost portion of the spur roller 71 positioned at the second position is disposed on the axis M of the driving roller 61. Further, as shown in FIG. 6, when the spur roller 71 is positioned at the second position at which the angle θ1 is the right angle, the lowermost portion of the spur roller 71 is positioned on the line N which connects the center of the shaft portion 74 of the spur roller 71 and the center of the shaft portion 62 of the driving roller 61. When the spur roller 71 is positioned at the first position, the spur roller 71 is arranged at the position at which the lowermost portion of the spur roller 71 is overlapped in the vertical direction with respect to the portion of the driving roller 61 disposed on the upstream side from the line N in relation to the transport direction E.

The rotatable member 82 is supported by the upper guide 51 in a state in which the protruding portion 51*b* is inserted into the torsion coil spring 84. In this situation, one end of the torsion coil spring 84 is engaged with the protruding portion 51 c, and the other end is engaged with the protruding portion 82*c*. Accordingly, the roller support member 80 is urged in the direction in which the first position is provided. Specifically, the roller support member 80 is urged in the direction of the arrow F (clockwise direction as shown in FIGS. 4A and 4B) by the torsion coil spring 84. In other words, the spur roller 71 is not brought in contact with the recording paper P, and the spur roller 71 is arranged at the first position in the state of no load.

Next, an explanation will be made below about the positioning operation for the recording paper P performed by the positioning mechanism 50.

When the recording paper P is transported to the positioning mechanism 50 by the transport roller pair 47, and the forward end of the recording paper P arrives at the oblique feeding roller pair 53, then the recording paper P is interposed by the oblique feeding roller pair 53, and the recording paper P is transported. In this situation, the driving roller 61 intends to transport the recording paper P in the transport direction E. However, the spur roller 71 is arranged so that the roller support member 80 is disposed at the first position. Therefore, the recording paper P is transported in the oblique direction with respect to the transport direction E (direction to make approach to the guide surface 54*a*).

When the recording paper P is transported obliquely, and the end portion of the forward end side thereof, which is disposed on the side of the guide surface 54*a*, is brought in contact with the guide surface 54*a*, then the concerning end portion of the recording paper P cannot advance any more toward the side of the guide surface 54*a*. Therefore, the rotational force is generated in the recording paper P about the center of the end portion brought in contact. In accordance with the rotational force, the end portion of the backward end side of the recording paper P, which is disposed on the side of the guide surface 54*a*, approaches the guide surface 54*a*. In this situation, the force, which is exerted from the recording paper P transported while generating the rotational force, is allowed to act on the spur roller 71, and the roller support member 80 is pivoted against the urging force of the torsion coil spring 84. In other words, the force, which is directed in the direction (counterclockwise direction as shown in FIGS. 4A and 4B) opposite to the arrow F, is generated in the roller support member 80. In this way, as shown in FIG. 5B, the spur roller 71 is moved so that the angle θ1, which is formed between the axis L and the guide surface 54*a*, is approximately the right angle. In other words, the roller support member 80 is pivoted from the first position so that the roller support member 80 is positioned at the second position. In this state, the recording paper P is transported in the transport direction E while bringing the end portion of the recording paper P on the side of the guide surface 54*a* in contact with the entire guide surface 54*a*. Thus, it is possible to position the recording paper P in the main scanning direction. When the recording paper P is transported, then the spur roller 71 is moved from the first position to the second position, and thus the force, which is exerted to extrude the recording paper P toward the guide surface 54*a*, is reduced or mitigated so that it is intended to suppress any damage of the recording paper P. If such an arrangement is provided that the spur roller 71 is not moved while being maintained at the first position when the recording paper P is transported, the recording paper P is transported toward the guide surface 54*a* by the spur roller 71 even after the recording paper P abuts against the guide surface 54*a*. In the case of this arrangement, the end portion of the recording paper P on the side of the guide surface 54*a* is strongly pressed against the guide surface 54*a*, and it is feared that the recording paper P may be bent and folded. When the end portion of the recording paper P on the side of the guide surface 54*a* abuts against the guide surface 54*a*, if the recording paper P intends to rotate about the center of the concerning end portion thereby, then any slippage arises with respect to the spur roller 71, and it is feared that the recording paper P may be damaged.

When the backward end side of the recording paper P passes through the oblique feeding roller pair 53, the roller support member 80 is restored from the second position to be disposed at the first position by means of the urging force of the torsion coil spring 54. When the roller support member 80 is disposed at the second position, the lowermost portion of the spur roller 71 is positioned on the axis M of the driving roller 61. Therefore, even when the roller support member 80 is restored to be disposed at the first position, the lowermost portion of the spur roller 71 does not exceed the uppermost portion of the driving roller 61. Therefore, the spur roller 71 is moved with ease. Further, the protruding portion 51*b*, which is the center of rotation of the roller support member 80, is disposed on the axis L. Therefore, the direction of rotation of the roller support member 80 is approximately the same as the direction of rotation of the spur roller 71 which is the driven roller. Accordingly, the spur roller 71 can be moved from the second position to the first position while being rotated. Therefore, it is possible to relatively decrease the friction between the spur roller 71 and the driving roller 61 when the spur roller 71 is moved. As a result, the spur roller 71 can be moved to the first position with ease.

As described above, according to the transport apparatus 3 concerning the embodiment of the present invention, when the recording paper P is transported by the driving roller 61 and the spur roller 71, the spur roller 71 is moved from the first position to the second position after the recording paper P abuts against the guide surface 54*a*. After that, the spur roller 71 is returned from the second position to the first position after the recording paper P passes through the space between the driving roller 61 and the spur roller 71. In this arrangement, the protruding portion 51*b*, which serves as the center of rotation of the roller support member 80 for holding the spur roller 71, is arranged on the axis L of the shaft portion 74 of the spur roller 71. Therefore, the direction, in which the urging force is exerted by the torsion coil spring 84 (direction of rotation of the roller support member 80), is approximately the same as the direction of rotation of the spur roller 71. Accordingly, the spur roller 71 is moved while being rotated from the second position toward the first position. Therefore, the friction between the spur roller 71 and the driving roller 61 is decreased when the spur roller 71 is moved. The spur roller 71 is moved with ease.

The protruding portion 51*b* is arranged at the position far from the guide surface 54*a* as compared with the end portion of the spur roller 71 on the side far from the guide surface 54*a* as well as the center of the spur roller 71, in relation to the extending direction of the axis L. Accordingly, the spur roller 71 is moved more easily from the first position to the second position by utilizing the force received from the recording paper P to be transported.

The spur roller 71 is adopted for the roller to be brought in contact with the surface on which the image is recorded. Therefore, even when the recording paper P, which has the image recorded on the surface, is transported to the recording paper refeed path, it is possible to suppress the deterioration of the image which would be otherwise caused by the spur roller 71. Further, the printer 1 has the positioning mechanism 50 arranged in the recording paper refeed path. Therefore, when the recording is performed on the both surfaces (both sides) of the recording paper P, it is possible to position the recording paper P just before the recording on the back side.

In a modified embodiment, the lowermost portion of the spur roller 71 positioned at the second position may be disposed on the upstream side in the transport direction E from the axis M of the driving roller 61. Also in this arrangement, it is possible to obtain such an effect that the friction between the spur roller 71 and the driving roller 61 is decreased when the spur roller 71 is moved, and the spur roller 71 is moved with ease.

Figure 7A:
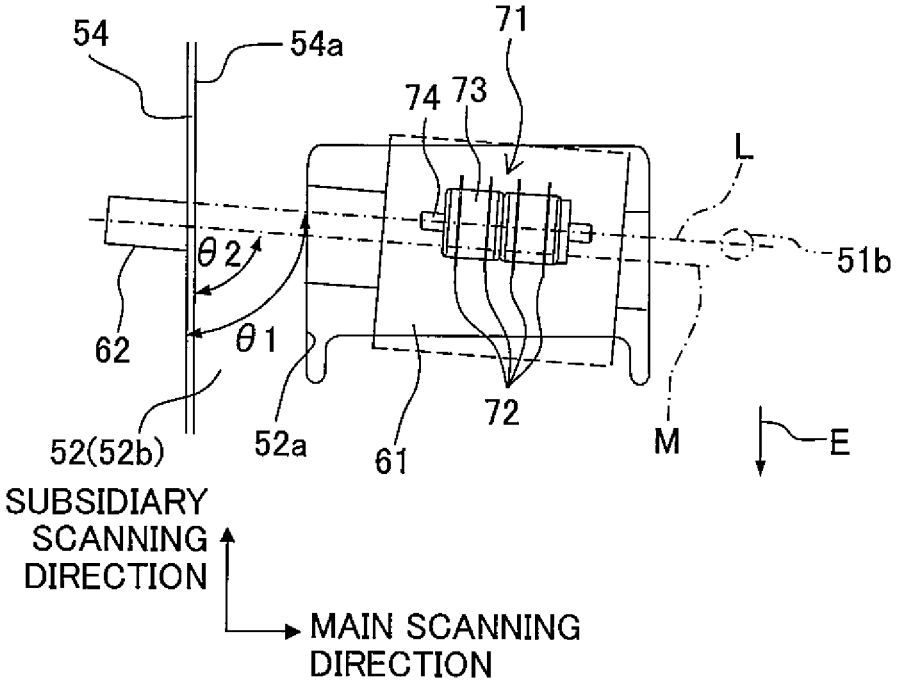
Figure 7B:
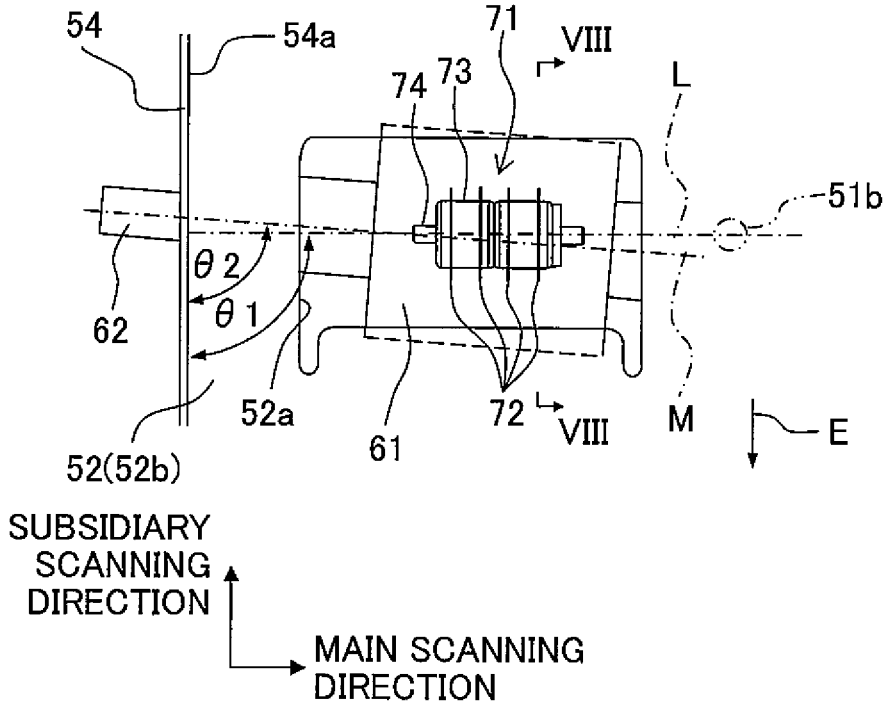
Figure 8:
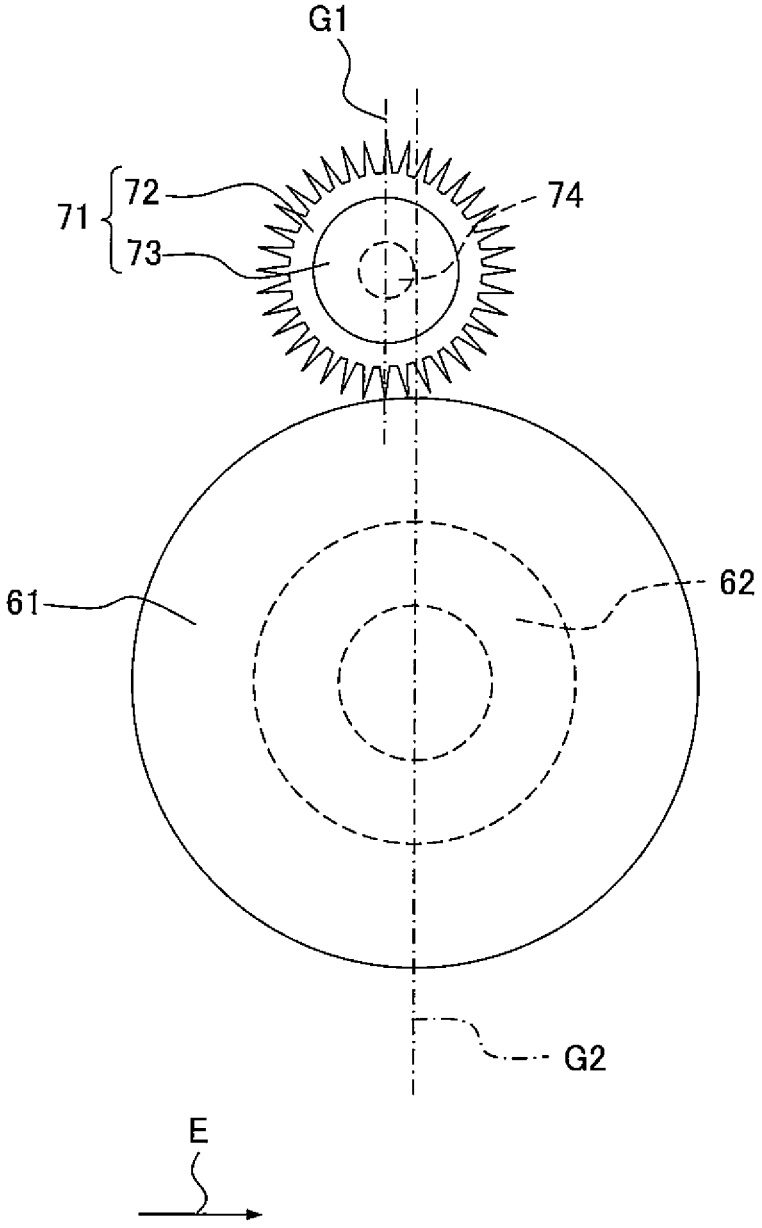
FIG. 8 shows a sectional view illustrating the oblique feeding roller pair, taken along a line VIII-VIII shown in FIG. 7B.

In another modified embodiment, as shown in FIGS. 7A and 7B, it is also appropriate that the driving roller 61 is arranged so that the angle θ2, which is formed by the axis M of the driving roller 61 and the portion of the guide surface 54*a* disposed on the downstream side in the transport direction E from the point of intersection between the axis M of the driving roller 61 and the guide surface 54*a*, is an acute angle. In this case, as shown in FIG. 7B, the portion, which is included in the lowermost portion of the spur roller 71 disposed at the second position and which is disposed farthest from the guide surface 54*a* (spur 72 disposed at the position farthest from the guide surface 54*a*, of the four spurs 72), may be disposed on the upstream side in the transport direction E from the axis M of the driving roller 61. In other words, as shown in FIG. 8, when the spur roller 71 is disposed at the second position at which the angle θ1 is the right angle, the vertical line G1, which passes through the center of the shaft portion 74 of the spur roller 71, may be disposed on the upstream side in the transport direction E as compared with the vertical line G2 which passes through the center of the shaft portion 62 of the driving roller 61. As shown in FIG. 7A, when the spur roller 71 is disposed at the first position, the lowermost portion of the spur roller 71 is arranged at the position overlapped with the upstream portion of the driving roller 61 from the axis M in the vertical direction, in relation to the transport direction E. Also in this case, in the same manner as in the embodiment described above, even when the roller support member 80 is restored to be disposed at the first position from the second position, the lowermost portion of the spur roller 71 does not exceed the uppermost portion of the driving roller 61. Therefore, the spur roller 71 is moved with ease.

In the another modified embodiment described above, the portion of the lowermost portion of the spur roller 71 disposed at the second position, which is positioned farthest from the guide surface 54*a*, may be disposed on the axis M of the driving roller 61. Also in this case, even when the roller support member 80 is restored to be positioned at the first position from the second position, the lowermost portion of the spur roller 71 does not exceed the uppermost portion of the driving roller 61. Therefore, it is possible to obtain such an effect that the spur roller 71 is moved with ease.

The preferred embodiments of the present invention have been explained above. However, the present invention is not limited to the embodiments described above, for which various changes can be made within a range of definition of claims. For example, the protruding portion 51*b*, which serves as the axis of rotation of the roller support member 80, may be arranged at a position overlapped with the spur roller 71, provided that the protruding portion 51*b* is disposed at the position far from the guide surface 54*a* as compared with the center of the spur roller 71 in relation to the extending direction of the axis L. Also in this case, it is possible to obtain the effect which is the same as or equivalent to that obtained as described above. The compression coil spring 83 and the torsion coil spring 84 are adopted as the urging members. However, the urging member may be composed of any elastic member such as rubber or the like, provided that the urging action can be performed in the same manner as described above. It is also allowable that the compression coil spring 83 is not provided. In this case, the driving roller 61 may be pressed by the self-weight of the spur roller 71 or the like. The spur roller 71 is arranged over or above the driving roller 61. However, the spur roller 71 may be provided under or below the driving roller 61. Alternatively, the spur roller 71 may be arranged while being aligned in any direction including the horizontal direction. In this case, the lowermost portion of the spur roller 71 may be referred to as follows in other words. That is, the lowermost portion of the spur roller 71 is the portion of the outer circumference of the spur roller 71 disposed closest or nearest to the driving roller 61.

In the embodiment and respective modified embodiments described above, the spur roller 71 is adopted as the second roller. However, it is also allowable to adopt a rubber roller or a resin roller having no projection. Further, it is also allowable to adopt a bead roller having a plurality of projections on an outer circumferential side surface. The guide surface 54*a* described above is the vertical plane (vertical surface) including the subsidiary scanning direction in the in-plane direction. However, the guide surface 54*a* may be inclined with respect to the vertical plane in relation to the perpendicular direction perpendicular to the transport direction E. Further, the guide surface 54*a* may be a surface which is curved in the transport direction of the recording paper P.

The present invention can be adopted for any transport apparatus provided that the transport apparatus can transport the medium. Further, the present invention is applicable to any one of the line type and the serial type. Further, the present invention is also applicable to the facsimile, the copying machine or the like, without being limited to the printer. Further, the present invention is applicable to any recording apparatus including, for example, those of the laser type and the thermal type provided that the recording apparatus records the image. The recording medium is not limited to the recording paper P, and the recording medium may be various media capable of performing the recording thereon.

What is claimed is:

1. A transport apparatus comprising:

a guide surface which extends in a transport direction for transporting a medium and which is configured to guide the medium to be transported;

a first roller which is a driving roller for transporting the medium;

a second roller which is a driven roller arranged to face the first roller; and a roller support member which rotatably supports the second roller and which is configured to be pivotable about a support shaft extending in a direction perpendicular to an axis of a rotational shaft of the second roller between a first position and a second position, wherein in a state that the roller support member is positioned at the first position, an angle formed by a portion of the guide surface, which is disposed on a downstream side in the transport direction from a point of intersection between the axis of the rotational shaft of the second roller and the guide surface, and the axis of the rotational shaft of the second roller is an acute angle, wherein in a state that the roller support member is positioned at the second position, the angle approaches a right angle as compared with the state that the roller support member is positioned at the first position, and wherein a center of the second roller is positioned between the support shaft and the guide surface in relation to an axial direction of the rotational shaft of the second roller.

2. The transport apparatus according to claim 1, further comprising a first urging member which urges the roller support member in a direction in which the second roller is disposed at the first position.

3. The transport apparatus according to claim 2, wherein the second roller is positioned between the support shaft and the guide surface in relation to the axial direction.

4. The transport apparatus according to claim 2, further comprising a second urging member which urges the second roller in a direction in which the second roller presses the first roller, wherein the first roller is arranged so that an axis of a rotational shaft of the first roller is perpendicular to the guide surface, the second roller is arranged above the first roller, and a lowermost portion of the second roller is positioned on one of the axis of the rotational shaft of the first roller and an upstream side in the transport direction from the axis of the rotational shaft of the first roller irrelevant to a position of the second roller.

5. The transport apparatus according to claim 4, wherein in the state that the roller support member is positioned at the second position, the lowermost portion of the second roller is positioned on the axis of the rotational shaft of the first roller.

6. The transport apparatus according to claim 2, further comprising a second urging member which urges the second roller in a direction in which the second roller presses the first roller, wherein the first roller is arranged so that an angle formed by a portion of the guide surface, which is disposed on the downstream side in the transport direction from a point of intersection between an axis of a rotational shaft of the first roller and the guide surface, and the axis of the rotational shaft of the first roller is an acute angle, the second roller is arranged above the first roller, and in the state that the roller support member is positioned at the second position, a part of a lowermost portion of the second roller, which is positioned farthest from the guide surface, is positioned on one of the axis of the rotational shaft of the first roller and an upstream side in the transport direction from the axis of the rotational shaft of the first roller.

7. The transport apparatus according to claim 1, wherein the support shaft is provided on the axis of the rotational shaft of the second roller.

8. The transport apparatus according to claim 1, further comprising a transport surface which extends in a perpendicular direction to the guide surface and which is configured to support a lower surface of the medium to be transported, wherein the support shaft is parallel to the guide surface and perpendicular to the transport surface, and the rotational shaft of the second roller is perpendicular to the support shaft.

9. The transport apparatus according to claim 8, further comprising an upper guide arranged to face the transport surface and provided with a protruding portion protruding toward the transport surface, wherein the roller support member comprises:

a holding member which rotatably holds the second roller; and a rotatable member formed with a slotted hole into which the protruding portion is inserted to regulate a movement range of the roller support member.

10. The transport apparatus according to claim 1, wherein the roller support member extends in an axial direction of the rotational shaft of the second roller.

11. The transport apparatus according to claim 1, wherein the second roller is a spur roller.

12. A recording apparatus comprising:

the transport apparatus as defined in claim 1; and a recording head which records an image on the medium.

13. The recording apparatus according to claim 12, wherein the transport apparatus is arranged in a refeed path provided to return the medium, which has been passed through an area opposed to the recording head, to an upstream side from the area opposed to the recording head.

* * * * *